US005085060A

United States Patent [19]

Matsushita

[11] Patent Number: 5,085,060

[45] Date of Patent: Feb. 4, 1992

[54] CLIP RING TYPE ORNAMENTAL CLASP

[75] Inventor: Koji Matsushita, Sapporo, Japan

[73] Assignee: Ladies Houshoku Company Ltd., Sapporo, Japan

[21] Appl. No.: 727,019

[22] Filed: Jul. 8, 1991

[30] Foreign Application Priority Data

Mar. 2, 1991 [JP] Japan ..... 3-18302

[51] Int. Cl.[5] ..... A44C 25/00

[52] U.S. Cl. ..... 63/2; 63/14.3; 63/20; 24/507; 24/521

[58] Field of Search ..... 63/2, 18, 19, 20, 14.3; 24/505, 511, 507, 521

[56] References Cited

U.S. PATENT DOCUMENTS

| | | | |
|---|---|---|---|
| 1,864,523 | 6/1932 | Biber | 63/2 |
| 1,908,469 | 5/1933 | Aanerud | 63/20 |
| 2,140,594 | 12/1938 | Placco | 63/20 |
| 2,285,051 | 6/1942 | Pujol | 63/20 |
| 2,763,999 | 9/1956 | Norman | 63/14.3 |

FOREIGN PATENT DOCUMENTS

| | | | |
|---|---|---|---|
| 214681 | 9/1960 | Austria | 63/20 |
| 461172 | 12/1913 | France | 63/14.3 |
| 1136518 | 11/1955 | France | 63/20 |
| 45704 | 4/1957 | France | 63/14.3 |

*Primary Examiner*—Rodney M. Lindsey
*Assistant Examiner*—F. Saether
*Attorney, Agent, or Firm*—Armstrong, Nikaido, Marmelstein, Kubovcik & Murray

[57] ABSTRACT

Described herein is a clip ring type ornamental clasp which can be used in various ways for securely gripping thin material like a handkerchief as well as relatively thick material like a belt. A clip ring is pivotally attached on a gripping surface of an ornament body through a ring support member. A rubber sheet with a bulged portion in its center portion is securely bonded on the gripping surface, while an anti-slip cover structure of rubber or other material of a large frictional coefficient is fitted on the clip ring. The anti-slip cover structure is provided with an opening of a larger diameter than a cloth threading hole in the clip ring, so that the marginal edges of the cloth threading hole are exposed at the inner periphery of the opening in the cover structure. The ornamental clasp grips cloth or other article securely between the anti-slip member and the anti-slip cover structure with high gripping force, and can be used in various ways without slip-off. Marginal edge portions of the cloth threading hole are exposed at the inner periphery of the opening of the anti-slip cover structure, ensuring smooth and easy sliding movements of the cloth relative to the ornamental clasp when in released state.

2 Claims, 3 Drawing Sheets

CLIP RING TYPE ORNAMENTAL CLASP

BACKGROUND OF THE INVENTION

1. Field of the Invention

This invention relates to a clip ring type ornamental clasp suitable for use in retaining an Ascot tie, scarf, shoal, handkerchief or the like (hereinafter referred to collectively as "cloth") in a desired shape or for stopping an end of a shoulder strap of a bag, belt or the like.

2. Description of the Prior Art

Shown in FIGS. 1 and 2 is a conventional ornamental clasp of the type mentioned above, having a metal ornament body 1 of substantially elliptical shape in plan view, which is provided with an indented ornamental surface 1A on the front side and a flat gripping surface 1B on the rear side thereof. A natural or synthetic gem 2 is fitted in the indented decorative surface of the ornament body 1.

Indicated at 3 is a ring support member of metal for pivotally supporting a clip ring 5 on the ornament body 1 as will be described hereinafter. The ring support member 3 includes as its integral parts a transversely oblong, rectangular spring nest 3A substantially of U-shape in cross section, a pair of brackets 3B extending sideward from the opposite longitudinal ends of the spring nest 3A, and ring support holes 3C formed in the brackets 3B. The ring support member 3 is fixed to the gripping surface 1B of the ornament body 1 by brazing.

The reference 4 denotes a leaf spring which is accommodated in the spring nest 3A of the ring support member 3 and substantially of M-shape in section having a sunken depressing portion at the center thereof. The spring 4 constantly biases the clip ring 5 toward the ornament body 1.

The clip ring 5 is made of metal and serves to hold a strip or strips of cloth like a scarf A against the gripping surface 1B of the ornament body 1. The clip ring 5 has a transversely oblong, plate-like base portion 6 which is provided with a pair of pivoting pin portions 6A at the opposite longitudinal ends thereof for fitting engagement in the ring support holes 3C of the ring support member 3.

Designated at 7 is an annular clip ring body which is formed along the peripheral edge of the ornament body 1, defining a cloth threading hole 8 in which cloth is to be threaded. The clip ring body 7 includes a base end portion 7A which is bent in the shape of J relative to the base portion 6, an intermediate portion 7B which is curved in a convex shape relative to the gripping surface 1B of the ornament body 1, a fore end portion 7C which is to be pressed against the gripping surface 1B, and a distal end 7D which is bent in a direction away from the gripping surface 1B, the ring body 7 being in the shape of the letter S as a whole.

Indicated at 9 is a spring presser which is protruded from the base portion 6 on the side remote from the clip ring body 7 and engageable with the leaf spring 4 to push down the depressing portion of the spring. Thus, the prior art clip ring 5 is integrally composed of a base portion 6 with a couple of pivoting pin portions 6A, a clip ring body 7, a cloth threading hole 8 for threading cloth therethrough, and a leaf spring presser 9.

The prior art clip ring type ornamental clasp with the above-described construction is used, for example, as a brooch to stop part of a scarf A in the following manner. Firstly, the clip ring 5 is pulled upward against the biasing force of the leaf spring 4 into the released position where it is disposed substantially at right angles with the ornament body 1. Nextly, the meeting ends of the scarf A which is wrapped around a neck or shoulders are threaded together through the cloth threading hole 8 of the clip ring 5, and, while pulling the opposite ends of the scarf A downward, the ornamental clasp is slided upward to a desired position on the scarf A before turning the clip ring body 7 toward the ornament body 1 against the action of the leaf spring 4. As the clip ring body 7 is turned toward the ornament body 1, the ornamental clasp is fixed halfway on the scarf A by gripping the latter between the ornament body 1 and the clip ring body 7.

The prior art clip ring type ornamental clasp of this sort however has a drawback or problem that it easily slips along the scarf A which is gripped between the ornament body 1 and clip ring 5 both of metal.

Besides, the clip ring 5 is so shaped as to be spaced in its middle portion from the gripping surface 1B of the ornamental body 1 for the purpose of facilitating the action of pulling up the clip ring 5 with a finger tip. Therefore, the gripping force of the clip ring 5 acts only in the fore end portion 7C of the clip ring body 7, failing to hold the scarf A securely in cooperation with the ornament body 1. This gives rise to a problem that the ornamental clasp readily slips off a scarf A and gets lost, as well as a problem that a scarf A which is wrapped around a neck or shoulders is likely to get loose during use, failing to retain an originally arranged shape. Especially, in case of a scarf A which becomes thinner gradually toward the ends to be stopped, it is difficult to attach the ornamental clasp on the end portions of the scarf A where the ornamental clasp has almost no effective gripping force. It follows that the user is deprived of the pleasure of using the ornamental clasp for fixing meeting ends of a scarf A after arranging same in a desired shape.

In addition, the prior art clip ring type ornamental clasp has relatively weak gripping force, which is insufficient for use as a stopper for a shoulder strap of a bag or for a belt end, thus restricting the range of its use.

SUMMARY OF THE INVENTION

In view of the above-mentioned drawbacks or problems of the prior art, the present invention has as its object the provision of a clip ring type ornamental clasp which can securely grip not only thin materials like handkerchieves but also articles of greater thickness like belts, free of the problem of positional deviations.

In accordance with the present invention, there is provided a clip ring type ornamental clasp including an ornament body having an ornamental surface on the front side and a gripping surface on the rear side thereof, an annular clip ring having a cloth threading hole and pivotally supported on the gripping surface of the ornament body through a ring support member for pivoting movements toward and away from the gripping surface of the ornament body, and a spring mounted on the ring support and adapted to bias the clip ring constantly toward the gripping surface of the ornament body, characterized in that the ornamental clasp comprises: an anti-slip member securely fixed on the gripping surface of the ornament body; an annular anti-slip cover structure fitted on the clip ring and having a lower anti-slip surface on the lower side thereof in face to face relation with the anti-slip member, the anti-slip cover structure having an opening of a larger diameter than the cloth threading hole of the clip ring to expose the inner marginal edge portions of the clip ring along the inner periphery of the anti-slip cover structure in a predetermined width.

Preferably, the anti-slip member is provided with a bulged portion projecting toward the opening of the anti-slip cover structure.

With the above-described ornamental clasp construction, a strip of cloth can be securely gripped between the anti-slip member and anti-slip cover structure which have high frictional coefficient. Besides, the inner marginal edge portions of the clip ring which are exposed along the inner periphery of the anti-slip cover structure ensure smooth sliding movement of the cloth which has been threaded into the hole of the clip ring.

The bulged portion on the anti-slip member which engages with the opening of the anti-slip cover structure contribute to augment the gripping force on the cloth as well as the contact area with the cloth.

BRIEF DESCRIPTION OF THE DRAWINGS

The above and other objects, features and advantages of the invention will become apparent from the following description and the appended claim, taken in conjunction with the accompanying drawings which show by way of example a preferred embodiment of the invention and in which:

DESCRIPTION OF PREFERRED EMBODIMENTS

Figure 1:
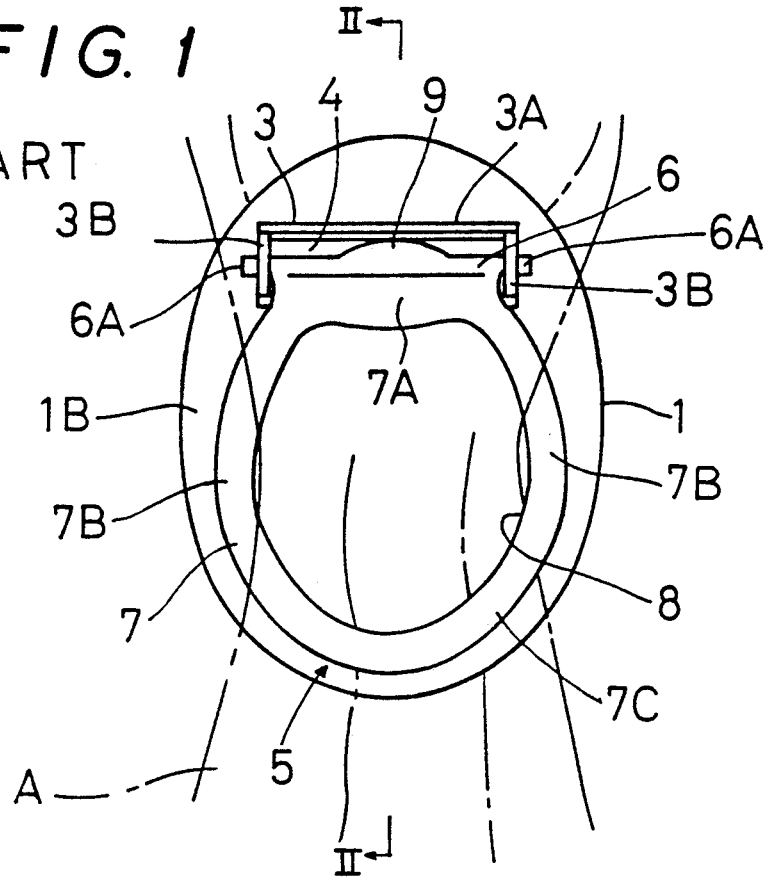
FIG. 1 PRIOR ART
FIG. 1 is a schematic plan view of a conventional clip ring type brooch.
Figure 2:
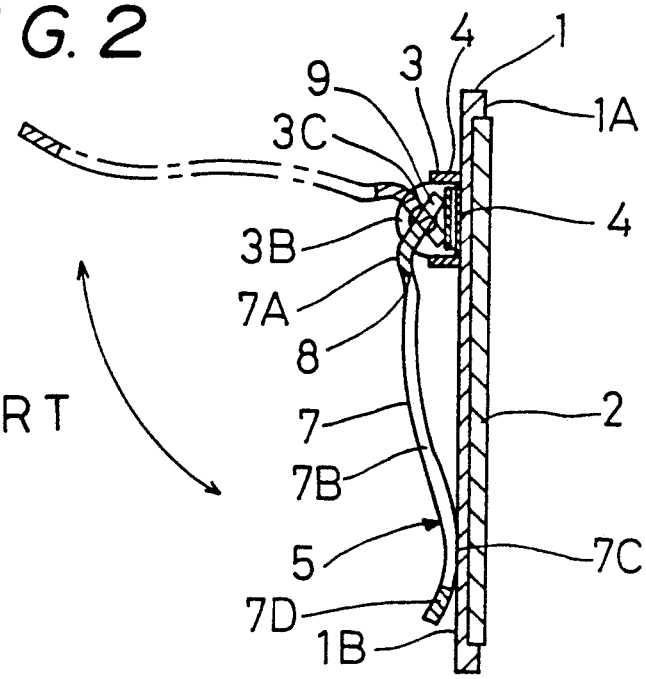
FIG. 2 PRIOR ART
FIG. 2 is a sectional view taken on line II—II of FIG. 1.
Figure 3:
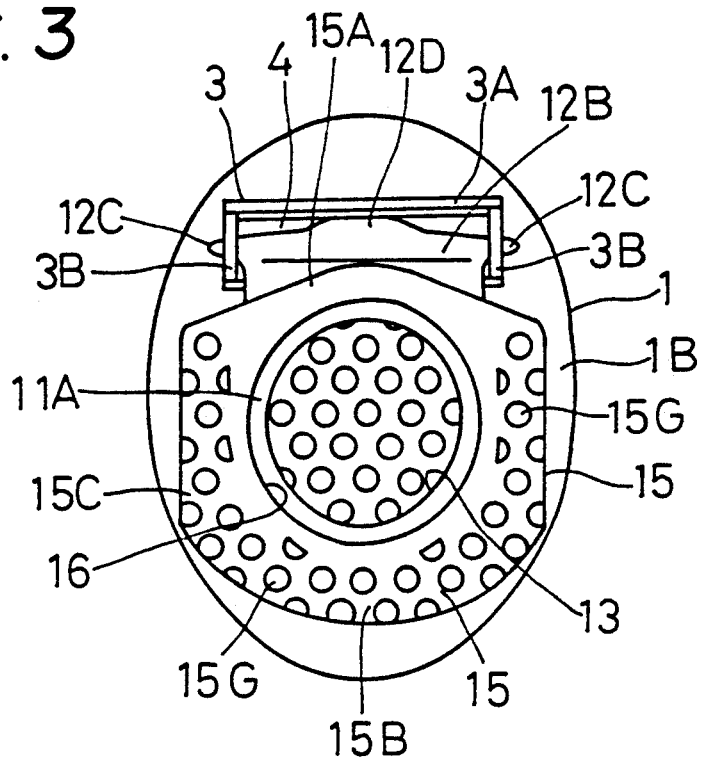
FIG. 3 is a plan view of a clip ring type ornamental clasp according to the present invention.
Figure 4:
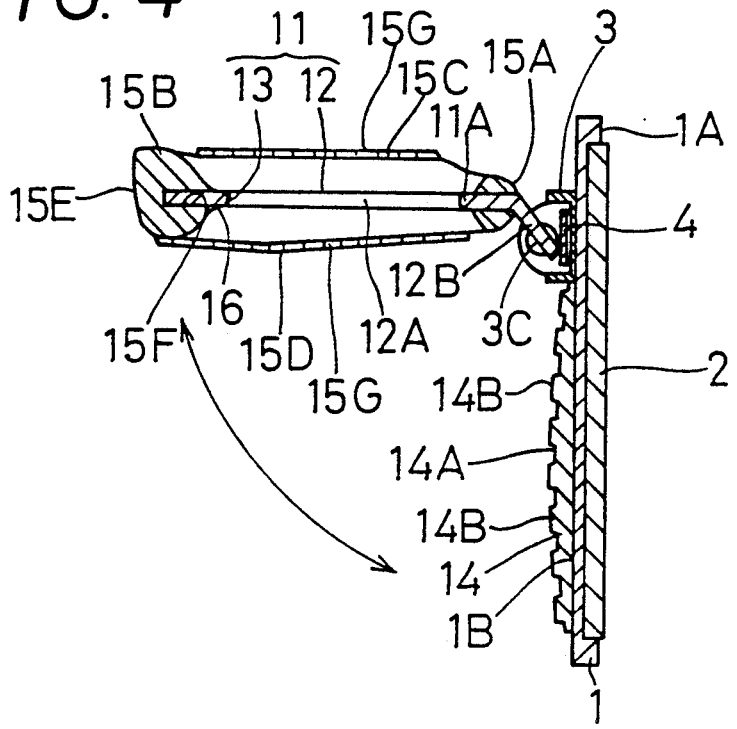
FIG. 4 is a sectional view of the ornamental clasp of FIG. 3, with a clip ring pulled into an upright released position.
Figure 5:
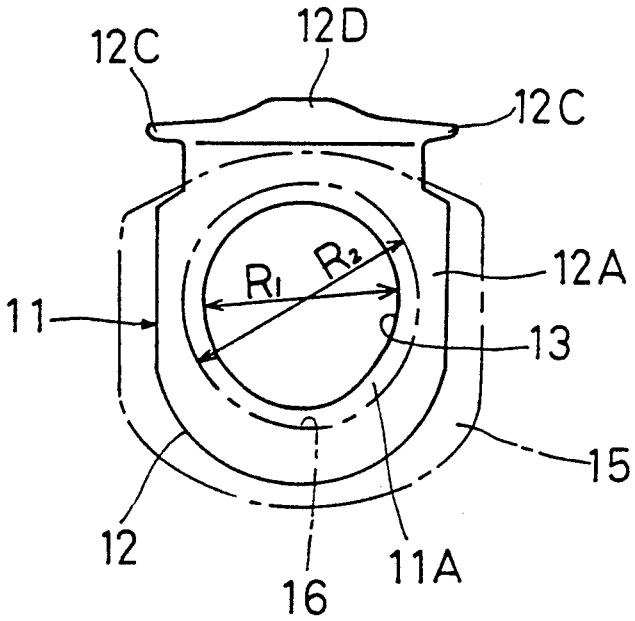
FIG. 5 is a plan view of the clip ring.

Now, the invention is described more particularly by way of the preferred embodiment shown in FIGS. 3 through 5. In the following description, those component parts which are common with the above-described conventional counterpart are designated by common reference numerals and their explanations are omitted to avoid unnecessary repetitions.

In these figures, indicated at 11 is a metal clip ring which is employed in the present embodiment, and at 12 is a base plate of the clip ring 11, the base plate 12 including a clip portion 12A which is formed substantially in U-shape at its outer periphery, a connecting portion 12B which extends angularly from the proximal end of the clip portion 12A, a pair of lateral projections 12C which extend laterally outward from the opposite ends of the connecting portion 12B, and a spring presser portion 12D which is protruded from the connecting portion 12B at a median point between the lateral projections 12C. On the other hand, indicated at 13 is a cloth threading hole which is opened centrally in the clip portion 12A of the base plate 12, the cloth threading hole 13 being substantially of an oval shape with a diameter of $R_1$.

Thus, the clip ring 11 is basically constituted by the base plate 12 and the cloth threading hole 13 opened in the base plate 12, and pivotally supported on the ornament body 1 by fitting the lateral projections 12C in the ring support holes 3C in the ring support member 3.

Designated at 14 is a sheet of semi-oval shape which is formed of rubber or other material with a large frictional coefficient. The rubber sheet 14 is bonded on the gripping surface 1B of the ornament body 1 except the area to which the ring support member 3 is fixed, and has a gradually increasing thickness toward its center portion to form a bulged portion 14A which rises toward the clip ring 11. A large number of gripping projections 14B are formed on the entire surface of the rubber sheet 14.

On the other hand, an anti-slip cover structure 15 of rubber or of a material with a large frictional coefficient is fitted on the other side of the clip ring 11. In this particular embodiment, the anti-slip cover structure 15 is integrally provided with an angularly shaped end face 15A located at one end side of the clip ring 11, an upper anti-slip surface 15C with a raised surface 15B at the other free end, a lower anti-slip surface 15D facing the aforementioned rubber sheet 14, a finger grip surface 15E substantially of a convex shape in plan view having an end face bulging out in a greater degree on the side of the upper anti-slip surface 15C than on the side of the lower anti-slip surface 15D, and a ring holder slit or groove 15F extending from the end face 15A to the finger grip 15E.

The upper and lower anti-slip surfaces 15C and 15D are covered with a large number of projections 15G except a narrow void zone of about 1 mm in width, which is provided around the marginal edges of an opening 16 formed in the anti-slip cover structure 15.

The opening 16 in the anti-slip cover structure 15 is formed through the upper and lower anti-slip surfaces 15C and 15D in coaxial relation with the cloth threading hole 13 to permit passage therethrough of cloth or other article to be stopped. In this instance, the opening 16 is formed in a diameter $R_2$ which is slightly larger than the diameter $R_1$ of the cloth threading hole 13, so that the inner peripheral edges 11A of the clip ring 11 are exposed over a predetermined width on the inner side of the opening 16 when the anti-slip cover structure 15 is fitted on the clip ring 11. As mentioned hereinbefore, the anti-slip cover structure 15 with the opening 16 is securely fixed to the clip ring 11 by the use of an adhesive after inserting the clip portion 12A of the ring 11 in the ring holder slit 15F.

The above-described embodiment of the invention is useful for gripping between the clip ring 11 and the ornament body 1 a scarf A or other article such as Ascot tie, handkerchief or the like which has been passed through the cloth threading hole 13 of the clip ring 11, basically in the same manner as the prior art counterparts mentioned hereinbefore.

However, according to the present invention, a scarf A is gripped between the rubber sheet 14 boned on the gripping surface 1B of the ornament body 1 and the anti-slip cover structure 15 fitted on the clip ring 11, which have far higher resistance to sliding movement of the scarf than in the prior art arrangement. Accordingly, as compared with the prior art counterpart which relies only on the force of strong leaf spring, the clip ring type ornamental clasp of the invention can exert a higher retaining force securely without causing damages to the gripped cloth even in case of a very thin handkerchief, precluding slip-off of the ornament during use and at the same time preventing the scarf A from loosening and getting out of an originally arranged shape.

The user therefore can have a broader freedom in arranging the scarf A in a desired shape since the clasp securely grips even a thin end portion of the scarf A. On the other hand, in a case where the clasp is used for stopping a shoulder strap of a bag, the clasp can be securely fastened to the strap by its strong gripping force. The upper anti-slip surface 15C of the cover structure 15, which is held in non-sliding contact with a coat or the like, prevents shifts of the ornamental clasp from the stopped position.

Further, according to the present embodiment, the bulged portion 14A at the center of the rubber sheet 14 contributes to apply the gripping force more securely by increasing the area of contact with the scarf A.

The opening 16 of the anti-slip cover structure 15 is formed in the diameter $R_2$, which is larger than the diameter $R_1$ of the cloth threading hole 13, to expose the inner peripheral edge portion 11A of the clip ring 11 over a predetermined width. Therefore, the scarf A passed through the cloth threading hole 13 is held in direct contact with the metal clip ring 11 of a small frictional coefficient and kept out of contact with the anti-slip cover structure 15 of a large frictional coefficient, permitting smooth sliding movements of the scarf A relative to the ornamental clasp without applying an unreasonably large force which might cause damages to the scarf A.

Although the clip ring type ornamental clasp of the invention has been described as a brooch for a scarf A, it can be similarly used for stopping Ascot ties, neckties, and lady's belts, for retaining shapes of ribbons and pocket handkerchieves, or for stopping a cotton handkerchief or the like around a neck in the fashion of a collar. In addition to the use as a brooch, it permits a variety of usages which have been impossible with the conventional ornamental clasps, for example, to use the clasp as a pendant by passing a chain through the ring support 3 between the ornament body 1 and clip ring 11.

Furthermore, instead of the circular opening 16 in the foregoing embodiment, the anti-slip cover structure 15 may be provided with an opening of a partly notched U-shape in plan view or of a heart or rhombic shape.

POSSIBILITIES OF INDUSTRIAL APPLICATION

It will be appreciated from the foregoing particular description that the ornamental clasp according to the invention is arranged to grip a strip of cloth or other article between the anti-slip member fixed on the side of the ornament body and the anti-slip cover structure fitted on the clip ring, holding the cloth with a stronger gripping force as compared with the prior art counterpart. Accordingly, the ornamental clasp is suitably prevented from getting lost by spontaneously slipping off the cloth, and there are less possibilities of the cloth loosening and getting out of an originally arranged shape. Since the clasp can securely grip even a narrow and thin strip of cloth such as a tip end of a scarf or the like, the user can have greater freedom in arranging cloth in a desired shape.

Besides, the inner peripheral portions of the clip ring which are exposed at the inner periphery of the anti-slip cover structure ensures smooth sliding movement of the cloth relative to the ornamental clasp, so that the user can thread a strip of cloth through the clip ring or arrange the shape of the cloth in a facilitated manner without causing damages to the cloth.

Further, the bulged portion at the center of the anti-slip member increases the area of contact with the cloth, thereby imparting extremely high gripping force to the clip ring type ornamental clasp.

What is claimed is:

1. A clip ring type ornamental clasp including an ornament body having an ornamental surface on the front side and a gripping surface on the rear side thereof, an annular clip ring having a cloth threading hole and pivotally supported on said gripping surface of said ornament body through a ring support member for pivoting movements toward and away from said gripping surface of said ornament body, and a spring mounted on said ring support member and adapted to bias said clip ring constantly toward said gripping surface of said ornament body, characterized in that said ornamental clasp comprises:

an anti-slip member securely fixed on said gripping surface of said ornament body; and an annular anti-slip cover structure fitted on said clip ring and having a lower anti-slip surface on the lower side thereof in face to face relation with said anti-slip member, said anti-slip cover structure having an opening of a larger diameter than said cloth threading hole of said clip ring to expose said inner marginal edge portions of said clip ring along said inner periphery of said anti-slip cover structure in a predetermined width.

2. A clip ring type ornamental clasp as defined in claim 1, wherein said anti-slip member is provided with a bulged portion projecting toward said opening of said anti-slip cover structure.

* * * * *